US006594873B2

(12) United States Patent
Argento

(10) Patent No.: US 6,594,873 B2
(45) Date of Patent: Jul. 22, 2003

(54) SLIDE CLOSURES FOR TOUCH FASTENERS

(76) Inventor: Claudio Argento, 153 W. Channel Rd., Apt. 3, Santa Monica, CA (US) 90402

( * ) Notice: Subject to any disclaimer, the term of this patent is extended or adjusted under 35 U.S.C. 154(b) by 0 days.

(21) Appl. No.: 10/036,537

(22) Filed: Nov. 8, 2001

(65) Prior Publication Data

US 2003/0084552 A1 May 8, 2003

(51) Int. Cl.[7] ..... A44B 18/00
(52) U.S. Cl. ..... 24/416; 24/381; 24/427; 24/442
(58) Field of Search ..... 24/442, 381, 416, 24/427

(56) References Cited

U.S. PATENT DOCUMENTS

| | | | | | |
|---|---|---|---|---|---|
| 1,666,110 | A | | 4/1928 | Stathaum | |
| 3,220,076 | A | | 11/1965 | Ausuit et al. | |
| 3,324,520 | A | | 6/1967 | Ausnit | |
| 3,426,396 | A | | 2/1969 | Laguerre | |
| 3,431,605 | A | | 3/1969 | Hasslinger | |
| 3,475,810 | A | | 11/1969 | Mates | |
| 3,600,766 | A | * | 8/1971 | Alberts | 24/401 |
| 3,627,600 | A | * | 12/1971 | Reiter | 156/66 |
| 3,696,472 | A | | 10/1972 | Perina et al. | |
| 3,713,923 | A | | 1/1973 | Laguerre | |
| 4,199,845 | A | * | 4/1980 | Ausnit | 24/399 |
| 4,513,484 | A | | 4/1985 | Iblings | |
| 4,905,694 | A | * | 3/1990 | Will | 606/217 |
| 4,914,793 | A | * | 4/1990 | Rampolia et al. | 24/389 |
| 4,922,586 | A | * | 5/1990 | Robson | 24/399 |
| 4,944,072 | A | * | 7/1990 | Robson | 24/585.12 |
| 5,293,672 | A | * | 3/1994 | Tominaga et al. | 24/585.1 |
| 5,636,415 | A | | 6/1997 | James | |
| 5,655,268 | A | | 8/1997 | Keyaki et al. | |
| 5,991,980 | A | * | 11/1999 | Meager | 24/400 |
| 6,183,134 | B1 | * | 2/2001 | Malin | 383/210 |

* cited by examiner

*Primary Examiner*—James R. Brittain
(74) *Attorney, Agent, or Firm*—Guy Cumberbatch

(57) ABSTRACT

A slide closure for joining overlapping edges of flexible or rigid substrates having complementary touch fasteners thereon. The slide closure has a pair of closing surfaces facing each other and structure joining the closing surfaces together so as to define two channels opening in opposite directions. The substrates are received within the channels such that they overlap between the closing surfaces. The closing surfaces converge to a nip having a dimension small enough to cause the complementary touch fasteners to engage when the slide closure is displaced along the overlapping edges in a first direction. The slide closure may further include a spanning member disposed generally between the closing surfaces that serves to structurally join the closing surfaces, partly define the channels on either side, and provide diverging separating surfaces that cause the complementary touch fasteners to disengage when the slide closure is displaced in a second direction opposite the first direction. The touch fasteners may be Velcro or the like, and a slide closure may include a strap bracket for ease of manipulation. Guide grooves within the slide closure may be provided to receive ribs or other such features on the substrates and maintain the substrates within the slide closure.

23 Claims, 8 Drawing Sheets

SLIDE CLOSURES FOR TOUCH FASTENERS

FIELD OF THE INVENTION

The present invention relates to slide closures for joining a variety of substrates and, more particularly, to slide closures for joining overlapping substrate edges having touch fasteners such as VELCRO thereon.

BACKGROUND OF THE INVENTION

Numerous slide closures are known in the art for joining panels of flexible material, such as the opposed fabric panels joined by a zipper. Such slide closures are particularly useful for joining flexible material because they are designed to channel the two panels of material toward each other as they move along the opposed edges being joined. Another common example of slide closure is that found on plastic food storage bags. Such a slide closure channels the two aligned open edges of the bag toward each other and forces a rib on one edge into a complementary channel on the other edge in a dovetail arrangement.

Zippers, both metallic and plastic, are the slide closures of choice for garments and other fabric applications. Conventional zippers provide meshing teeth that relatively securely hold the two edges together. Of course, everyone has experienced zippers that bind due to material that catches in the teeth, or because one or more teeth become distorted. Another drawback with zippers is the potential for the meshing teeth to disengage which may prevent the slide closure from moving back across the affected area.

Because of the drawbacks associated with conventional slide closures, there is a need for an improved slide closure that reduces the potential for binding and is more forgiving when the edges that are joined together are inadvertently pulled apart.

SUMMARY OF THE INVENTION

The present invention provides a slide closure for joining complementary touch fasteners, comprising a slide closure body having channels opening on opposite sides for receiving overlapping edges of substrates having complementary touch fasteners thereon. The slide closure body includes first and second closing surfaces facing each other that converge toward one another to a nip defining a gap with a dimension sufficiently small to bring the first and second touch fasteners into engagement. The slide closure body is configured to move in one direction along the overlapping substrate edges and bring the edges together such that the complementary touch fasteners engage.

Preferably, each of the complementary touch fasteners has a width, the slide closure further comprising structure that connects the first and second closing surfaces including a spanning member having opposed faces. The structure and closing surfaces define the two channels each open to receive one of the substrates from one side of the slide closure. The channels having a width such that at least some of the widths of the first and second touch fasteners overlap between the closing surfaces and diverge around the opposed faces of the spanning member. In one embodiment, both the first and second closing surfaces are angled with respect to the directions in which the slide closure body moves, the convergence of the first and second closing surfaces compressing and engaging the complementary touch fasteners. Alternatively, only the first facing surface is angled with respect to the directions in which the slide closure body moves, the second facing surface being oriented generally parallel to the directions in which the slide closure body moves, the convergence of the first and second closing surfaces compressing and engaging the complementary touch fasteners.

In accordance with one preferred construction of the slide fastener, the first facing surface is defined on an inner surface of a first closing arm, and the second facing surface is defined on an inner surface of a second closing arm. Each of the first and second closing arms has a width substantially the same as the width of the spanning member, wherein each of the first and second closing arms attaches on a fixed side to the spanning member and is cantilevered across the width of the slide closure so that its inner surface partly defines one of the channels. The slide closure of further may include a first side wall attached to a first side of the spanning member and to the fixed side of the first closing arm, and a second side wall attached to a second side of the spanning member and to the fixed side of the second closing arm. The slide closure thus generally defines a Z-shape from the first closing arm through the first side wall across the spanning member through the second side wall and through the second closing arm.

In one aspect of the invention, the first and second closing surfaces are biased toward one another so that the nip gap is minimized. For example, the first and second closing surfaces may be formed separately from each other and from the spanning member, the slide closure including at least one spring biasing the first and second closing surfaces toward one another so that the nip gap is minimized. Desirably, the first and second closing surfaces are each formed on a closing arm having a side wall at one side, wherein the closing arms extend generally parallel to one another with the side walls disposed on opposite sides of the slide closure. Each side wall extends toward the opposite closing arm, and wherein portions of both side walls are aligned and each includes a hinge in which one side of the spanning member pivots. The spring is thus arranged to pivot the closing arms about the spanning member so that the nip gap is minimized.

The substrates may be provided with raised features, and the slide closure includes guide grooves for receiving the raised features and channeling the substrates therethrough.

The slide closure body may be configured to move in the direction along the overlapping substrate edges opposite the closing direction and separate the edges such that the complementary touch fasteners disengage. To do so, the slide fastener desirably has structure thereon that connects the first and second closing surfaces including a spanning member. The structure and closing surfaces define the two channels each open to receive one of the substrates from one side of the slide closure. The channels having a width such that at least some of the widths of the first and second touch fasteners overlap between the closing surfaces and diverge around the spanning member. The spanning member has a first separating surface, a second separating surface, and a nose in between the two separating surfaces, the nose pointing toward the nip. The spanning member is therefore adapted to cleave and separate the engaged touch fasteners when the slide closure body is moved in the opposite direction along the overlapping substrate edges.

Alternatively, the slide closure body may be configured to move in the both directions along the overlapping substrate edges and bring the edges together such that the complementary touch fasteners engage. In this construction, the first and second closing surfaces define a first pair of closing surfaces converging to a first nip. The slide closure body further includes a second pair of closing surfaces that converge toward one another to a second nip defining a gap with a dimension sufficiently small to bring the first and second touch fasteners into engagement.

In accordance with another aspect of the invention, a system for fastening a first touch fastener to a second touch fastener is provided, comprising a first substrate having a first elongate touch fastener along one edge, a second substrate having a second elongate touch fastener complementary to the first touch fastener, and a slide closure body having channels for receiving the substrates such that the first touch fastener faces the second touch fastener. The slide closure body is configured to move in one direction along the substrates and bring them together such that the complementary touch fasteners engage. The first and second substrates may comprise lengths of flexible sheet material, or the first substrate comprises a first length of flexible sheet material, and the second substrate comprises a rigid material.

A further understanding of the nature and advantages of the invention will become apparent by reference to the remaining portions of the specification and drawings.

DESCRIPTION OF THE PREFERRED EMBODIMENTS

Figure 1:
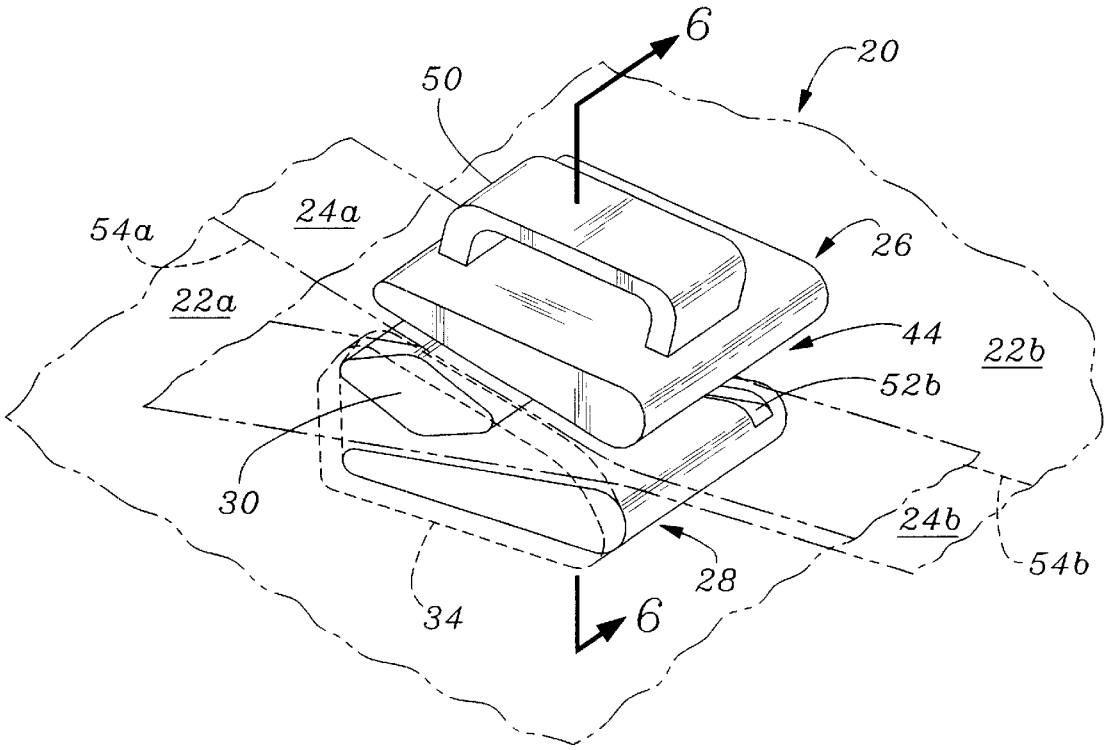
FIG. 1 is a perspective view of an exemplary slide closure of the present invention for joining two substrates having touch fasteners thereon (shown in phantom)
Figure 2:
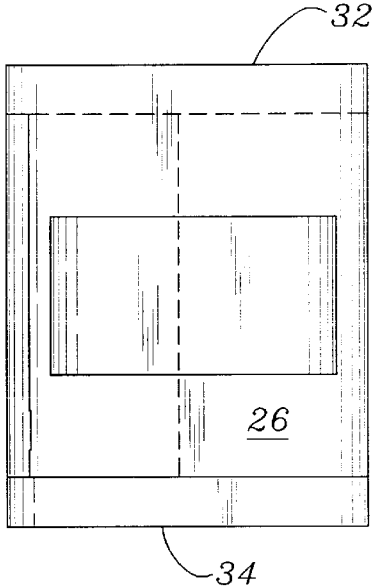
FIG. 2 is a top plan view of the slide closure of FIG. 1.
Figure 3:
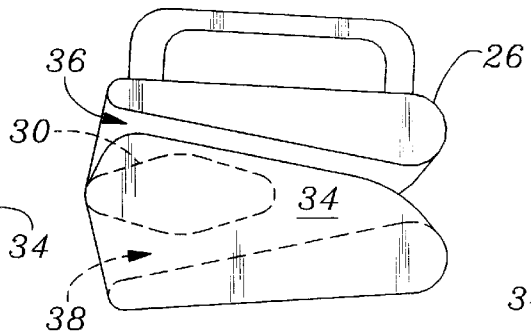
FIG. 3 is a side elevational view of the slide closure of FIG. 1.
Figure 4:
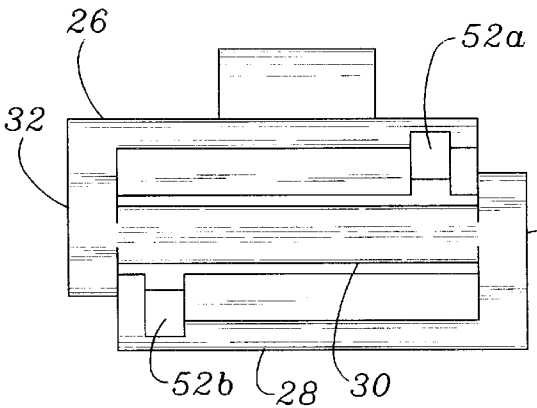
FIG. 4 is a left-end elevational view of the slide closure of FIG. 1.
Figure 5:
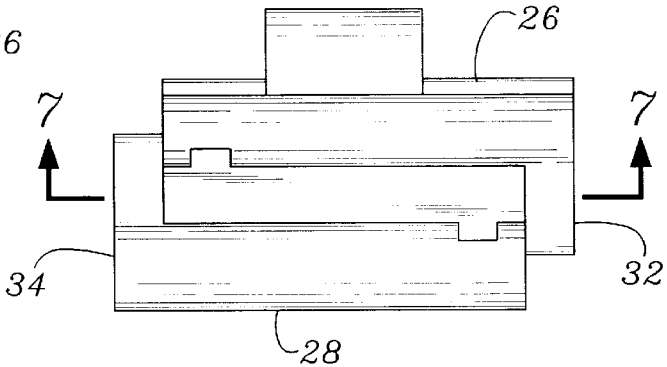
FIG. 5 is a right-end elevational view of slide closure of FIG. 1.

The present invention provides a slide closure for joining two substrates of material having touch fasteners thereon. The substrates may be flexible or one may be relatively more rigid than the other. For example, flexible substrates may be natural or synthetic fabric, plastic sheet, leather, metallic screen, or the like. Rigid substrates may be made of plastic, metal, or the like. The term "substrate" refers to any solid element on which a touch fastener may be provided. In the conventional sense, a "substrate" is a sheet-like element having an edge on which a predetermined width or strip of touch fastener is attached. The edge may be linear or curved. For purpose of the present invention, "substrate" encompasses both sheets and non-sheets, as long as a relatively thin edge or rail having the touch fastener thereon is provided. The slide closure therefore receives two relatively thin substrate edges in an overlapping manner and joins the complementary touch fasteners together.

In less formal terms, the present invention provides a touch fastener (e.g., VELCRO) zipper. The term "touch fastener" pertains to complementary structures on opposed surfaces of two substrates that join upon pressing the two substrates together. The term surface fastener is also sometimes used. The touch fastener structure exists over a surface area of the substrate, and thus there is area to area contact. Only slight compression of the complementary touch fasteners is required for at least some engagement, as opposed to the compression needed to engage a typical plastic bag closure. Further, there is less need for precise alignment of the complementary touch fasteners that would be the case with conventional zippers or plastic bag closures, for example. VELCRO is the most commonly known touch fastener, and is generically termed a hook and loop fastener by virtue of one substrate having a multitude of small hooks and the other substrate having a multitude of small fabric loops. Another example of a common touch fastener provides a multitude of closely spaced small pins having heads on both substrates, much like small mushrooms, the heads of the opposing pins being forced past each other upon compression of the substrates to join the substrates together.

The term "touch fastener" in the context of the present invention does not include conventional zipper-like structures such as meshing teeth or plastic ribs that mate in a dovetail fashion with complementary channels. The latter construction describes the closures at the top of plastic food storage bags that are sold with and without a slide closure. In addition to an absence of a "touch fastener," as defined in the present application, on the substrates being joined, these closures also are not designed to join two overlapping substrate edges. For example, the slide closure for a zipper having meshing teeth does not join overlapping substrates but instead joins two substrates edge-to-edge in a butt joint of sorts. In the same manner, the sides of a plastic food storage bag are juxtaposed and their edges end at approximately the same place facing the same direction. If a slide closure is used at the top of such a bag, the two juxtaposed edges are received by the slide closure from the same direction. In contrast, the present invention provides a slide closure that receives substrate edges from opposite directions, which edges then overlap within the slide closure.

To better explain the environment in which the slide closures of the present invention may be used, several specific examples will be provided, although those of skill in the art will understand that the invention has wide application beyond these examples. The slide closure may be used to join aligned edges of various fabrics together, such as in clothing, sleeping bags, luggage and carry bags, tarpaulins, and the like. The elimination of any binding that sometimes occurs in such articles having conventional zippers is a great advantage. Another example is the closure between a flexible substrate such as a fabric and a rigid edge, such as between a removable canvas top and the side wall of a truck or Jeep cargo area. Typically, such canvas tops attach to the side wall using a plurality of relatively rugged snaps, which can be a time-consuming and difficult task.

The slide closures of the present invention enable the use of touch fasteners in environments where zippers had been the only real option. Unlike zippers, however, the slide closures disclosed herein do not have meshing teeth and therefore problems with binding are substantially eliminated. Furthermore, once closed with the slide closure, the substrate edges can be opened with or without the use of the slide closure without fear of distorting the substrate edges, or of rendering the slide closure unusable. That is, the user need only run the slide closure along the now separated edges to place it back in a position to close the edges once again when moved in the other direction.

Figure 8:
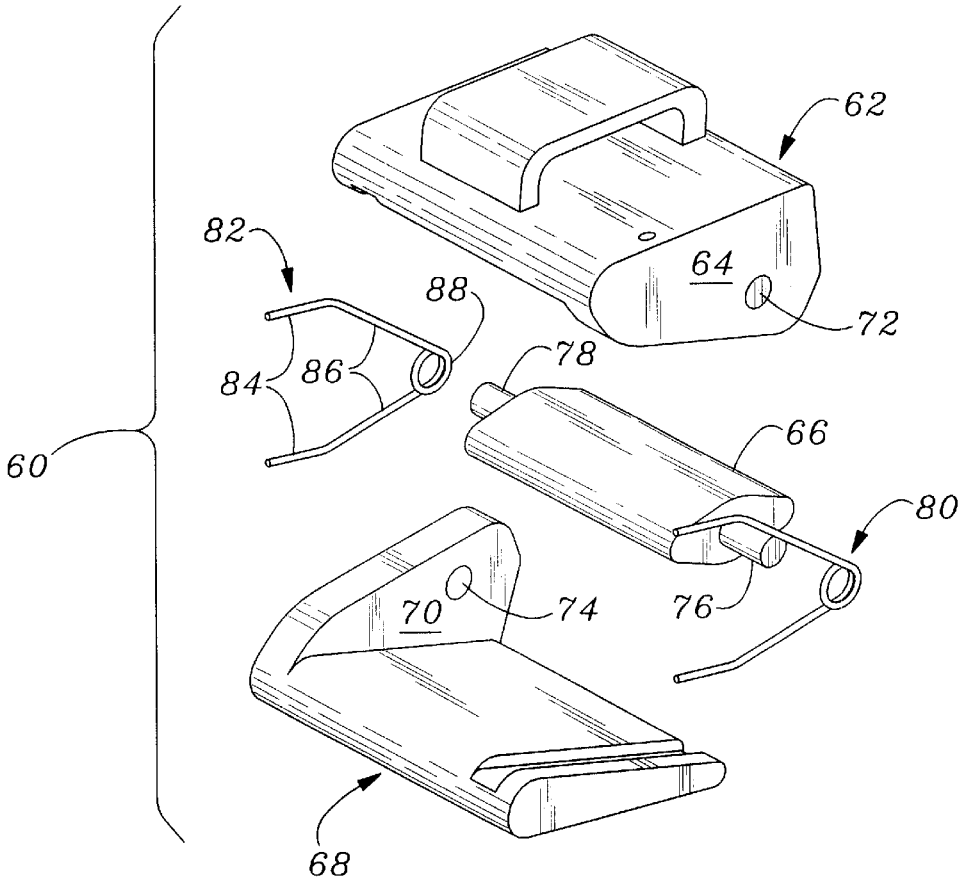
FIG. 8 is an exploded perspective view of a spring-biased slide closure of the present invention.
Figure 9:
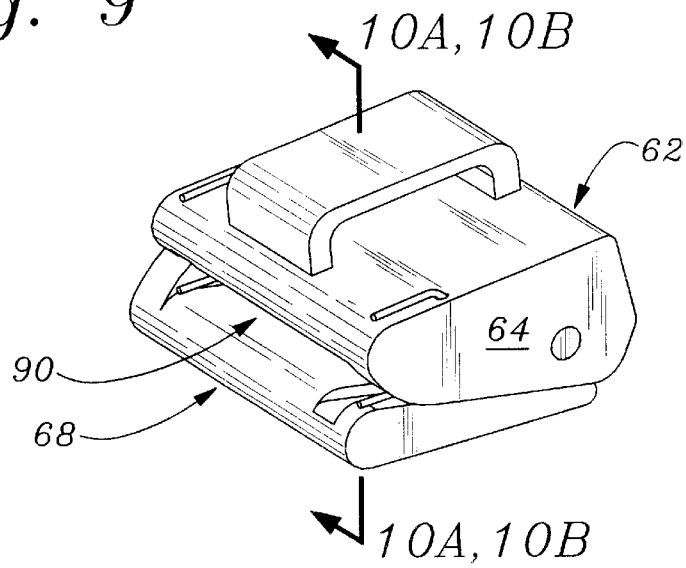
FIG. 9 is an assembled perspective view of the spring-biased slide closure of FIG. 8.
Figure 16:
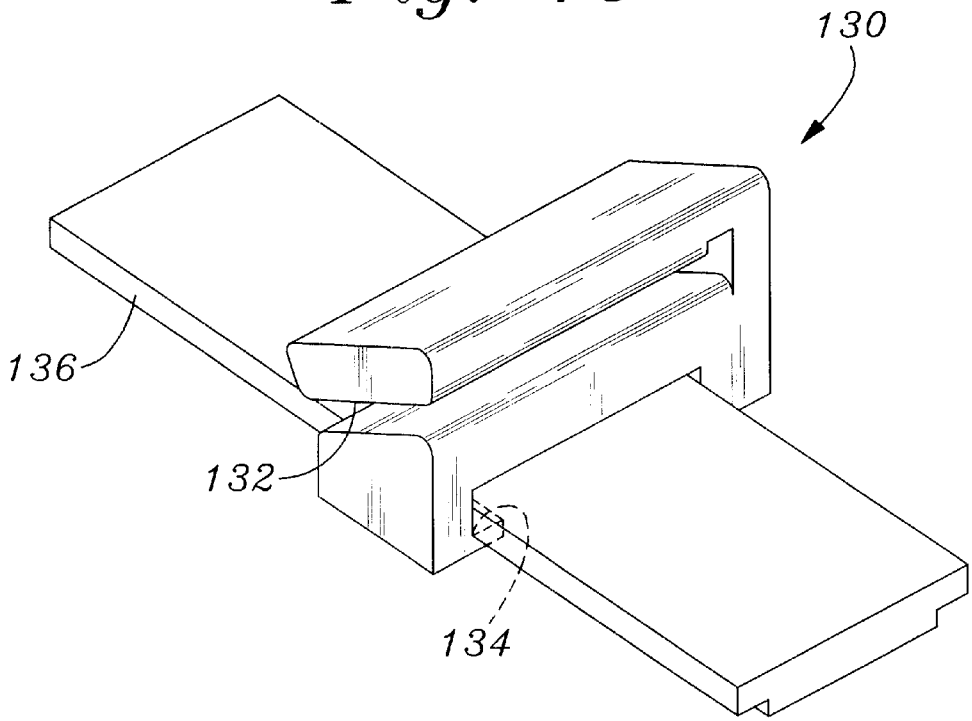
FIG. 16 is a perspective view of an alternative slide closure of the present invention suited for joining a flexible substrate to a rigid substrate.
Figure 17:
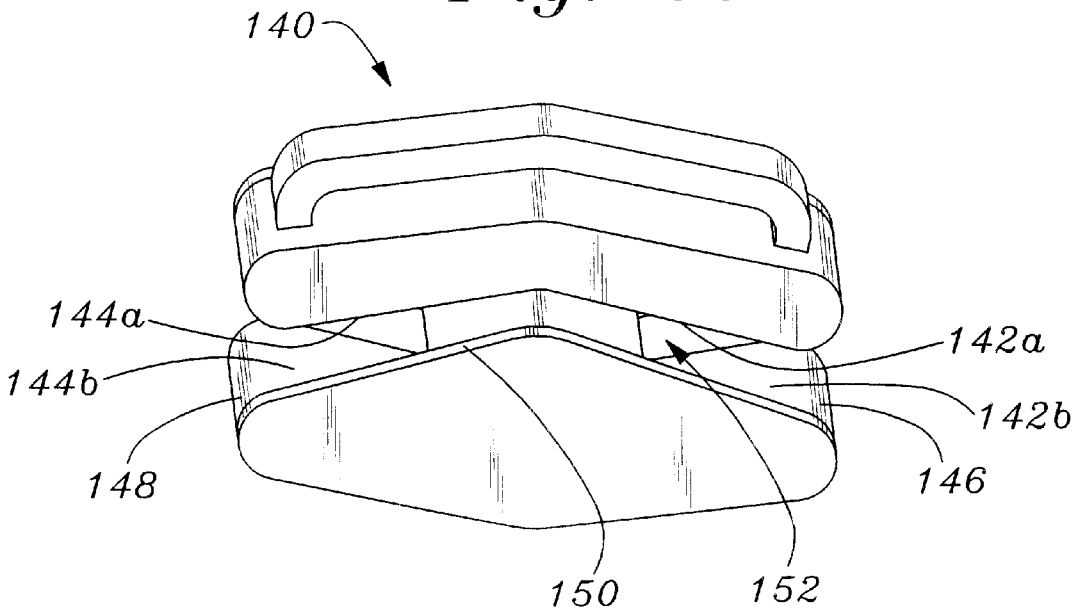
FIG. 17 is a perspective view of an alternative slide closure of the present invention that engages the touch fasteners on the substrate edges in either direction of movement.

With reference now to the figures, several exemplary embodiment will be described. FIGS. 1–7 disclose a first embodiment where the components of the slide closure are fixed with respect one another in a non-moving manner. FIGS. 8–10 disclose a second embodiment similar to the first but having moving components that are spring biased toward each other. FIGS. 11–15 illustrates a third embodiment having no moving components and being similar but elongated with respect to the first embodiment. FIG. 16 shows a still further embodiment for joining a flexible substrate to rigid substrate. FIG. 17 illustrates a slide closure having a closing mechanism like the first embodiment but capable of closing the touch fasteners when slid along the substrates in both directions.

FIG. 1 illustrates a first embodiment of a slide closure 20 joining the edges of first and second substrates 22*a*, 22*b*, which are shown in phantom. In this embodiment, the substrates 22*a*, 22*b* are flexible and have touch fasteners 24*a*, 24*b* along the edges being joined. For example, the substrates 22*a*, 22*b* may be some type of fabric, such as nylon, while the touch fasteners 24*a*, 24*b* are relatively narrow strips of complementary hook and loop material sewn along the edges being joined. For purpose of discussion, the direction along which the substrate edges and touch fasteners 24*a*, 24*b* extend will be termed the length direction, while the direction perpendicular to the length direction and in the plane of the substrate edge will be termed the width direction. The slide closure 20 has a width and receives the overlapping edges of the substrates 22*a*, 22*b* such that at least some of the width of each of the touch fasteners 24*a*, 24*b* resides within the slide closure.

The slide closure 20 comprises basically three structural components: a first closing arm 26 seen at the top of FIG. 1, a second closing arm 28 at the bottom of FIG. 1, and structure connecting the first and second closing arms including a spanning member 30 positioned between the two closing arms. The connecting structure between the first and second closing arms also includes a pair of side walls 32, 34, only one of which is shown in phantom in FIG. 1 while the other is obscured by the first closing arm 26.

With reference now to FIGS. 2–5, the arrangement of the components of the slide closure 20 can be seen more clearly. As seen from the top in FIG. 2, and from the side in FIG. 3, the first side wall 32 and the second side wall 34 extend the entire length of the slide closure 20. As seen best in FIGS. 4 and 5, the first side wall 32 connects the first closing arm 26 to the spanning member 30, while the second side wall 34 connects the second closing arm 28 to the spanning member. As viewed from the right in FIG. 5, this connection schematically resembles the letter "Z" thus creating channels 36, 38 (FIG. 3) within the slide closure for receiving the edges of the substrates 22*a*, 22*b*. The first closing wall 26 and the spanning member 30 define therebetween a first channel 36 opening to the front side of the slide closure 20. Likewise, the second closing wall 28 and the spanning member 30 define therebetween a second channel 38 opening to the rear side of the slide closure 20. Stated another way, each of the first and second closing arms 26, 28 attaches on a fixed side to the spanning member 30 via one of the side walls 32, 34 and is cantilevered across the width of the slide closure 20 so that its inner surface partly defines one of the channels 36, 38. FIG. 1 illustrates the direction in which the edges of the substrates 22*a*, 22*b* are received within these channels 36, 38.

Figure 6:
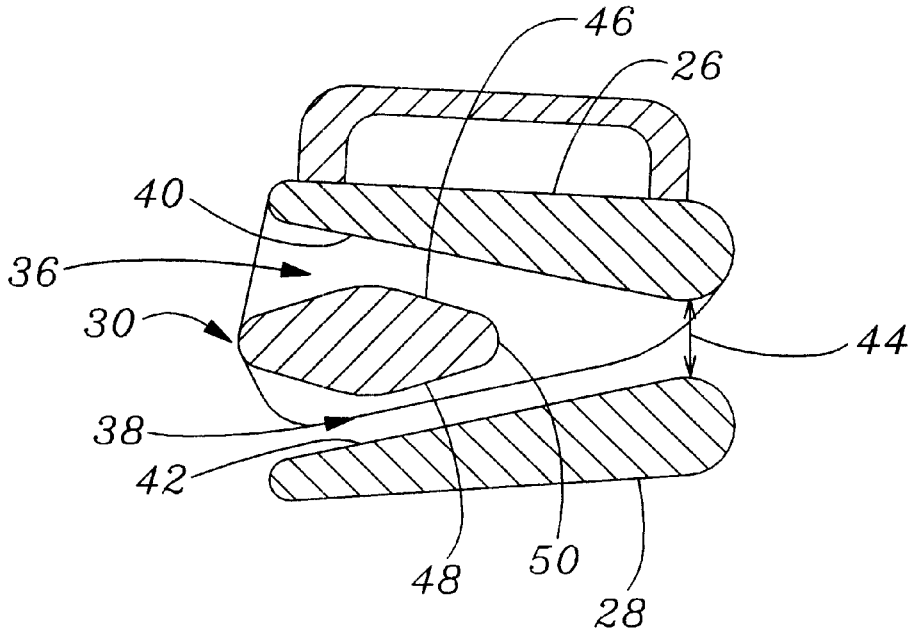
FIG. 6 is a vertical sectional view through the slide closure taken along line 6—6 of FIG. 1.
Figure 7:
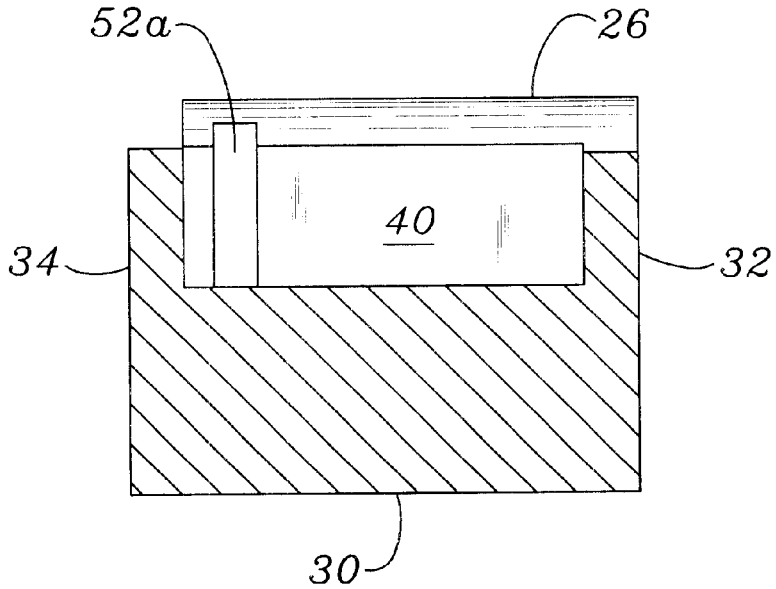
FIG. 7 is a horizontal sectional view through the slide closure taken along line 7—7 of FIG. 5.

With reference now to the cross-section of FIG. 6, the shapes of the first and second channels 36, 38 within the slide closure 20 are more clearly seen. The first closing arm 26 defines on the inside of the slide closure a first closing surface 40, while the second closing arm 28 defines a second closing surface 42 that generally faces the first closing surface. In the illustrated embodiment, both the first and second closing surfaces 40, 42 are angled with respect to the horizontal and converge from left to right to a nip 44. The edge of the first substrate 22*a* passes through the first channel 36, while the edge of the second substrate 22*b* passes through the second channel 38, and the two edges converge together in the nip 44. In this respect, the dimension of the nip 44 is sufficiently small to compress the edges of the two substrates 22*a*, 22*b* such that the touch fasteners 24*a*, 24*b* thereon engage. This mode of operation occurs when the slide closure 20 displaces to the left in FIG. 1 with respect to the substrates 22*a*, 22*b*.

The spanning member 30 provides three functions: it extends across the width of the slide closure 20 to structurally connect the first closing arm 26 and second closing arm 28; it partly defines both the first and second channels 36, 38; and, it also provides diverging or wedging surfaces that separate the touch fasteners 24*a*, 24*b* when the slide closure is moved to the right in FIG. 1 with respect to the substrates 22*a*, 22*b*. With reference again to FIG. 6, the spanning member 30 includes a first separating surface 46, a second separating surface 48, and a nose 50 in between the two separating surfaces. The separating surfaces 46,48 converge toward one another such that the nose 50 easily slides between and cleaves or separates the joined touch fasteners 24*a*, 24*b*. Preferably, the nose 50 is rounded to avoid catching on the touch fastener material.

With reference again to FIG. 1, the slide closure 20 may also include a strap bracket 50 attached to the first closing arm 26 to which a strap or other such gripping device may be coupled. As also seen in FIG. 1, but best seen in FIG. 4, slide closure 20 further may include first and second guide grooves 52*a*, 52*b* formed in the respective closing surfaces 40,42. The guide grooves 52*a*, 52*b* are shown as linear depressions that receive complementary features on the substrates 22*a*, 22*b*. For example, alignment ribs or other such raised features may be provided on the substrates that fit within and are guided by the grooves 52*a*, 52*b* to maintain the edges of the substrates within the slide closure 20. Instead of separate ribs, the touch fasteners 24*a*, 24*b* may be provided as strips that are sewn to the substrates 22*a*, 22*b* such that an edge of the strip or a thickened seam 54*a*, 54*b* (see FIG. 1) provides enough material to engage the respective guide groove 52*a*, 52*b*.

The slide closure 20 may be made of a variety of materials, although machined or molded plastic is preferred.

Furthermore, the slide closure 20 may be formed as a single, unitary piece, or may be made of several separately formed pieces that are glued or otherwise attached together. The dimensions of the slide closure 20 will vary depending on the application, though an exemplary size for use as a sleeping bag closure is about 1 inch in width and length.

FIGS. 8–10 disclose an alternative slide closure 60 of the present invention that has essentially the same components as the slide closure 20 described above but is spring-biased to help prevent binding on the substrates. The exploded view of FIG. 8 also illustrates one way that the slide closure 20 of the first embodiment may be formed from three separate pieces and then attached together.

The spring-biased slide closure 60 includes a first closing arm 62 having a first side wall 64 attached thereto. A spanning member 66 joins a second closing arm 68 to the first closing arm 62. The second closing arm 68 has a second side wall 70 attached thereto. Hinge bores 72, 74 are provided in the first and second side walls 64, 70, respectively. Hinge pins 76, 78 extend outward from the spanning member 66 and fit within the hinge bores 72, 74. In this manner, the first closing arm 62 pivots with respect to the second closing arm 68 about the axis defined by the hinge pins 76, 78. The assembly is held together using a pair of generally V-shaped springs 80, 82, as will be explained below.

Each spring 80, 82 has two spaced apart free ends 84 that are generally parallel to one another. The free ends 84 are at the terminal end of a pair of fingers 86 that converge and are joined together at a helical apex 88. Each helical apex 88 defines a bore therethrough that receives one of the hinge pins 78.

Figure 10A:
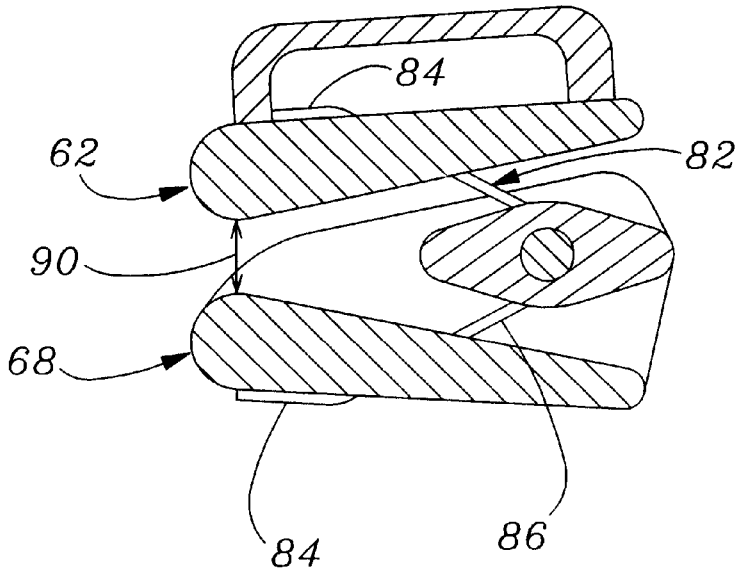
FIGS. 10A and 10B are vertical sectional views through the assembled spring-biased slide closure of FIG. 9 shown, respectively, in closed and open positions.
Figure 10B:
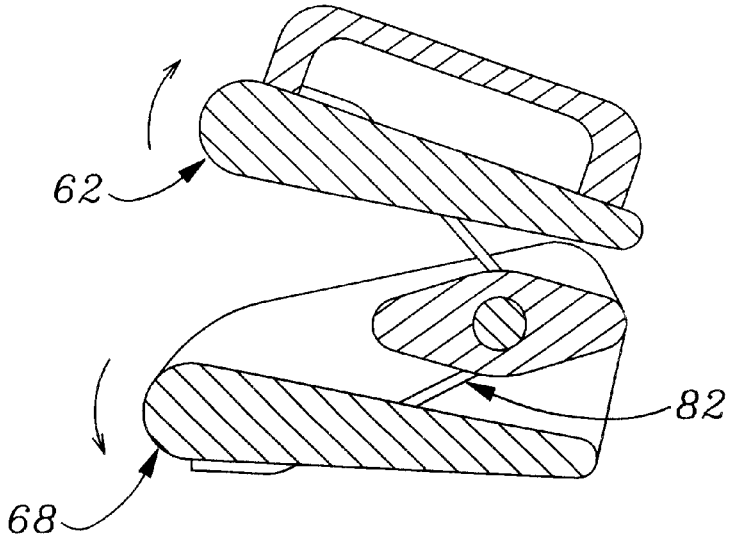

With reference to FIGS. 10A and 10B, the fingers 86 of each of the springs 80, 82 pass through holes in both the first and second closing arms 62, 68 such that the free ends 84 lie flush against the outer surfaces of the closing arms. The relaxed position of the spring is seen in FIG. 10A such that the nip 90 between the closing arm 62, 68 is minimized. FIG. 10B illustrates the closing arms 62, 68 pivoted apart against the force of the spring. This situation might occur intermittently upon bunching or folding of the substrate(s) passing through the slide closure 60. The closing arms 62, 68 will temporarily spread apart to permit passage of the obstruction, and then spring back together into the normal operating configuration of FIG. 10A.

FIGS. 11–15 illustrate a still further embodiment of a slide closure 100 having a first closing arm 102, a second closing arm 104, a first side wall 106, second side wall 108, and spanning member 110. As before, the spanning member 110 connects the first and second side walls 106, 108. In contrast to the first embodiment, the slide closure 100 is elongated such that the spanning member 110 does not reside directly between the first and second closing arms 102, 104. This construction may enable the slide closure 100 to be formed to have a lower thickness profile than the first embodiment.

Figure 11:
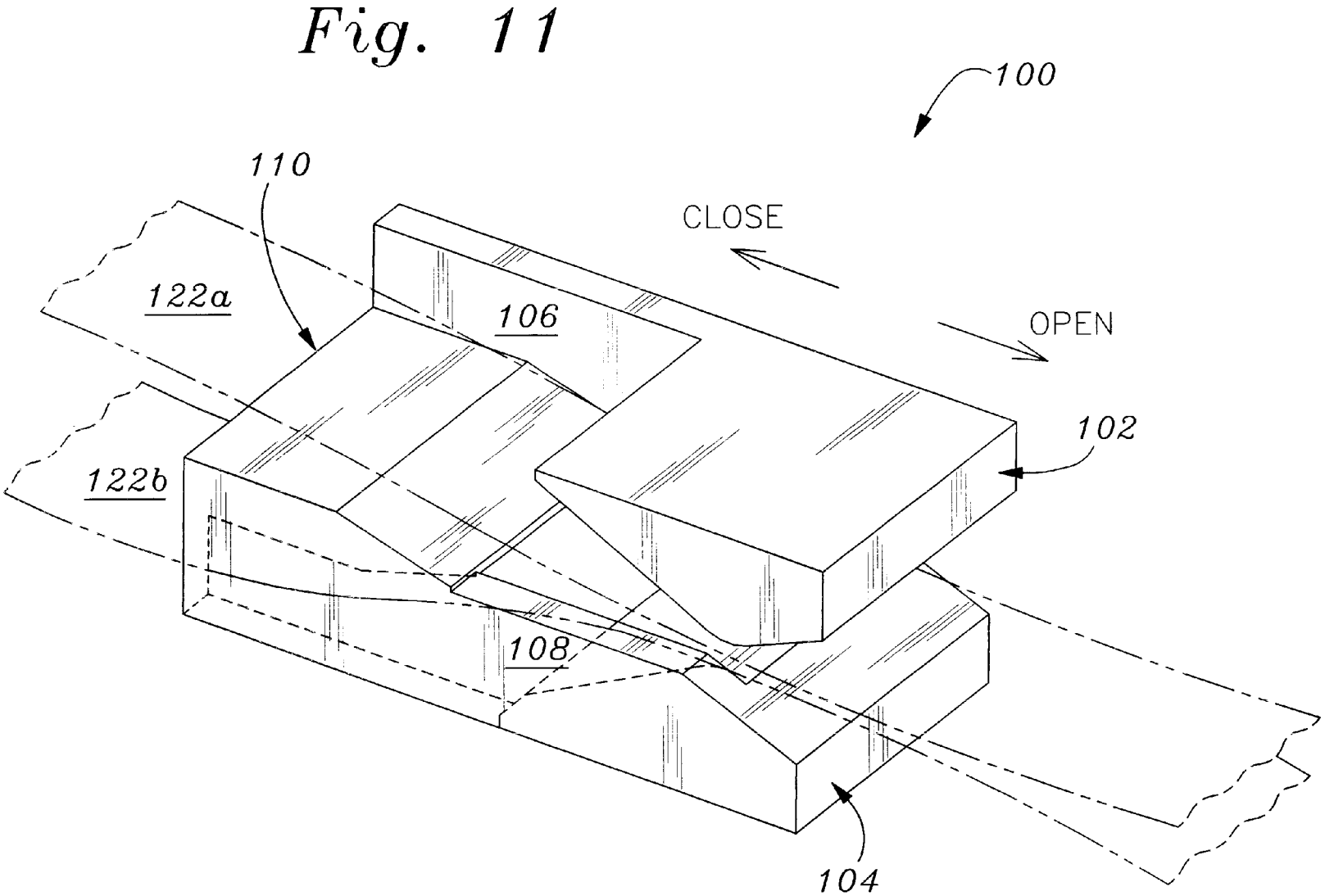
FIG. 11 is a perspective view of an alternative slide closure of the present invention for joining two substrates having touch fasteners thereon (shown in phantom)
Figure 12:
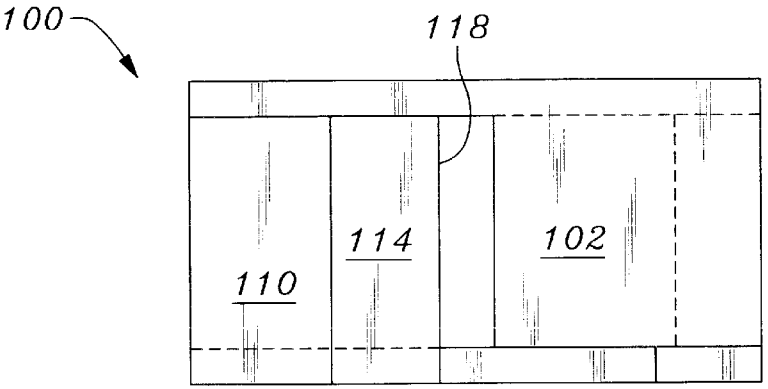
FIGS. 12–15 are top plan, side elevational, left-end elevational, and right-end elevational views on the slide closure of FIG. 11.
Figure 13:
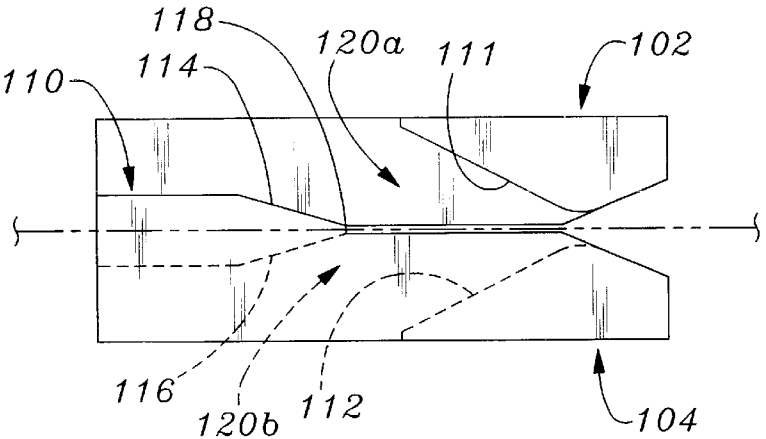
Figure 14:
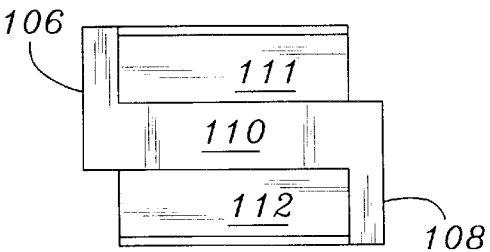
Figure 15:
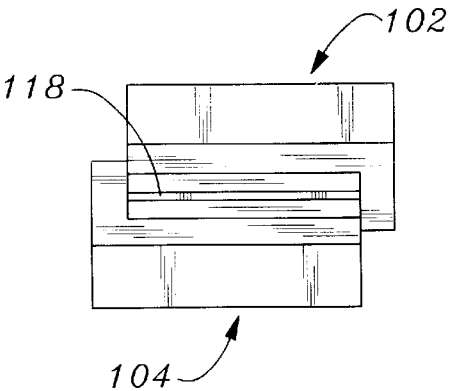

FIGS. 12–15 illustrate the various components as mentioned previously. Specifically, the slide closure 100 includes first and second closing surfaces 111, 112, and the spanning member 110 defines first and second separating surfaces 114, 116 tapering down to a nose 118. The first channel 120 for receiving one of the touch fasteners 122*a* (FIG. 11) is defined between the first closing surface 111 and the first separate surface 114. Likewise, the second channel 120*b* for receiving the other touch fastener 122*b* is defined between the second closing surface 112 and second separate surface 116. FIG. 11 indicates the directions in which the slide closure 100 moves to alternately open and close the touch fasteners 122*a*, 122*b*.

FIG. 16 is a perspective view of an alternative slide closure 130 that differs from the first embodiment in that a first closing surface 132 is angled with respect to the direction in which the slide closure moves along the substrate edges, while a second closing surface 134 is generally parallel to the direction of movement. The slide closure 130 is thus designed to join the flexible substrate to a rigid substrate. The rigid substrate passes through the channel that is partly defined by the second closing surface 134, while the flexible substrate passes through the other channel partly defined by the first closing surface 132 and is directed toward the rigid substrate. The channel that is partly defined by the second closing surface 134 is parallel to the direction of movement of the slide closure 130 so as to easily pass along the rigid substrate (i.e., an angled channel would not permit such movement.

FIG. 17 is a perspective view of another alternative slide closure 140 that differs from the first embodiment in that both a first pair of closing surfaces 142*a*, 142*b* and a second pair of closing surfaces 144*a*, 144*b* are provided converging toward two nips 146, 148. A spanning member 150 is still required between the oppositely opening channels 152, 154 to structurally connect the first and a second pairs of closing surfaces 142*a*, 142*b*, 144*a*, 144*b*. The slide closure 140 thus closes the edges of the substrates having the touch fasteners thereon in both directions of movement. One separates the substrate edges by simply tearing them apart by hand, except for where the slide closure 140 is located (typically at one end of the substrates or the other). From any location, the slide closure 140 is then moved in either direction along the edges, pulling them together and joining the touch fasteners thereon.

While the foregoing describes the preferred embodiments of the invention, various alternatives, modifications, and equivalents may be used. Moreover, it will be obvious that certain other modifications may be practiced within the scope of the appended claims.

What is claimed is:

1. A slide closure for joining complementary touch fasteners, comprising:

a slide closure body having channels opening on opposite sides for receiving overlapping edges of substrates having complementary touch fasteners thereon, the slide closure body including first and second closing surfaces facing each other that converge toward one another to a nip defining a gap with a dimension sufficiently small to bring the first and second touch fasteners into engagement, the slide closure body thus being configured to move in one direction along the overlapping substrate edges and bring the edges together such that the complementary touch fasteners engage, wherein the first and second closing surfaces are biased toward one another so that the nip gap is minimized.

2. The slide closure of claim 1, wherein each of the complementary touch fasteners has a width, the slide closure further comprising:

structure that connects the first and second closing surfaces including a spanning member having opposed faces, the structure and closing surfaces defining the two channels each open to receive one of the substrates from one side of the slide closure, the channels having a width such that at least some of the widths of the first and second touch fasteners overlap between the closing surfaces and diverge around the opposed faces of the spanning member.

3. The slide closure of claim 2, wherein both the first and second closing surfaces are angled with respect to the directions in which the slide closure body moves, the convergence of the first and second closing surfaces compressing and engaging the complementary touch fasteners.

4. The slide closure of claim 2, wherein the first facing surface is defined on an inner surface of a first closing arm, and the second facing surface is defined on an inner surface of a second closing arm, each of the first and second closing arms having a width substantially the same as the width of the spanning member, and wherein each of the first and second closing arms attaches on a fixed side to the spanning member and is cantilevered across the width of the slide closure so that its inner surface partly defines one of the channels.

5. The slide closure of claim 4, further including:

a first side wall attached to a first side of the spanning member, the first side wall also being attached to the fixed side of the first closing arm; and a second side wall attached to a second side of the spanning member, the second side wall also being attached to the fixed side of the second closing arm, the slide closure thus generally defining a Z-shape from the first closing arm through the first side wall across the spanning member through the second side wall and through the second closing arm.

6. The slide closure of claim 2, wherein the first and second closing surfaces are formed separately from each other and from the spanning member, the slide closure including at least one spring biasing the first and second closing surfaces toward one another so that the nip gap is minimized.

7. The slide closure of claim 6, wherein the first and second closing surfaces are each formed on a closing arm having a side wall at one side, wherein the closing arms extend generally parallel to one another with the side walls disposed on opposite sides of the slide closure, each side wall extending toward the opposite closing arm, and wherein portions of both side walls are aligned and each includes a hinge in which one side of the spanning member pivots, the spring being arranged to pivot the closing arms about the spanning member so that the nip gap is minimized.

8. The slide closure of claim 1, wherein the substrates are provided with raised features, and the slide closure includes guide grooves for receiving the raised features and channeling the substrates therethrough.

9. The slide closure of claim 1, the slide closure including at least one spring biasing the first and second closing surfaces toward one another so that the nip gap is minimized.

10. The slide closure of claim 1, wherein the slide closure body is also configured to move in the opposite direction along the overlapping substrate edges and separate the edges such that the complementary touch fasteners disengage.

11. The slide closure of claim 10, further including structure that connects the first and second closing surfaces including a spanning member, the structure and closing surfaces defining the two channels each open to receive one of the substrates from one side of the slide closure, the channels having a width such that at least some of the widths of the first and second touch fasteners overlap between the closing surfaces and diverge around the spanning member, the spanning member having a first separating surface, a second separating surface, and a nose in between the two separating surfaces, the nose pointing toward the nip and the spanning member adapted to cleave and separate the engaged touch fasteners when the slide closure body is moved in the opposite direction along the overlapping substrate edges.

12. The slide closure of claim 1, wherein the slide closure body is configured to move in the opposite direction along the overlapping substrate edges and bring the edges together such that the complementary touch fasteners engage.

13. The slide closure of claim 12, wherein the first and second closing surfaces define a first pair of closing surfaces converging to a first nip, the slide closure body further including a second pair of closing surfaces that converge toward one another to a second nip defining a gap with a dimension sufficiently small to bring the first and second touch fasteners into engagement.

14. A slide closure for joining first and second strips having complementary touch fasteners thereon, comprising:

first and second closing arms that are spaced apart at their closest point across a nip defining a gap with a dimension sufficiently narrow to bring the first and second touch fastener strips into engagement; and a spanning member between the first and second closing arms and connected thereto at opposite sides, the spanning member and closing arms together defining two channels opening from opposite sides of the slide closure and separated by the spanning member, the channels each being configured to receive one of the touch fastener strips such that the first and second touch fastener strips overlap within the slide closure, the slide closure thus being configured to move in a first direction along the touch fastener strips to bring the complementary touch fasteners into engagement, and in a second, opposite direction to separate the touch fasteners, wherein the first and second closing arms are biased toward one another so that the nip gap is minimized.

15. The slide closure of claim 14, wherein both the first and second closing arms have inner surfaces that are angled with respect to the directions in which the slide closure body moves along the touch fastener strips, the convergence of the inner surfaces of the first and second closing arms thus gradually compressing and engaging the complementary touch fasteners as the slide closure moves in the first direction along the touch fastener strips.

16. The slide closure of claim 14, wherein each of the first and second closing arms has a width substantially the same as a width of the spanning member, and wherein each of the first and second closing arms attaches on a fixed side to the spanning member and is cantilevered across the width of the spanning member so that its inner surface partly defines one of the channels.

17. The slide closure of claim 16, further including:

a first side wall attached to a first side of the spanning member, the first side wall also being attached to the fixed side of the first closing arm; and a second side wall attached to a second side of the spanning member, the second side wall also being attached to the fixed side of the second closing arm, wherein the slide closure thus generally defines a Z-shape from the first closing arm through the first side wall across the spanning member through the second side wall and through the second closing arm.

18. The slide closure of claim 14, wherein the first and second closing arms are formed separately from each other and from the spanning member, the slide closure including at least one spring biasing the first and second closing arms toward one another so that the nip gap is minimized.

19. The slide closure of claim 18, wherein the first and second closing arms are each fixedly connected to a side wall at one side, wherein the closing arms extend generally parallel to one another with the side walls disposed on opposite sides of the slide closure, each side wall extending toward the opposite closing arm, and wherein portions of both side walls are aligned and each includes a hinge in which one side of the spanning member pivots, the spring being arranged to pivot the closing arms about the spanning member so that the nip gap is minimized.

20. The slide closure of claim 14, wherein the touch fastener strips are provided with raised features, and the slide closure includes structure for interfering with the raised features and channeling the touch fastener strips therethrough.

21. The slide closure of claim 14, wherein the spanning member is aligned with the nip so as to also be aligned between the two touch fastener strips.

22. The slide closure of claim 21, wherein the spanning member has a first separating surface, a second separating surface, and a nose in between the two separating surfaces, the separating surfaces diverging apart from one another starting at the nose, the nose pointing toward the nip and the spanning member being adapted to cleave and separate the engaged touch fasteners when the slide closure body is moved in the opposite direction along the overlapping touch fastener strips.

23. The slide closure of claim 14, wherein the slide closure body is configured to move in the opposite direction along the overlapping substrate edges and bring the edges together such that the complementary touch fasteners engage.

* * * * *